United States Patent [19]

Gakhar

[11] 3,974,667

[45] Aug. 17, 1976

[54] WASHING MACHINE WITH IMPROVED ADDITIVE DISPENSING MEANS

[75] Inventor: Ved P. Gakhar, Louisville, Ky.

[73] Assignee: General Electric Company, Louisville, Ky.

[22] Filed: Aug. 20, 1975

[21] Appl. No.: 606,049

[52] U.S. Cl. ..... 68/17 R; 68/207; 134/100

[51] Int. Cl.[2] ..... D06F 39/02

[58] Field of Search..... 68/17 R, 207; 134/100, 134/101, 182, 183; 141/97

[56] References Cited

UNITED STATES PATENTS

| | | | |
|---|---|---|---|
| 3,019,629 | 2/1962 | Ross | 68/17 R |
| 3,033,427 | 5/1962 | Petersen | 68/17 R X |
| 3,118,297 | 1/1964 | Olding | 68/17 R X |
| 3,727,434 | 4/1973 | Bochan | 68/17 R |

*Primary Examiner*—Philip R. Coe

*Attorney, Agent, or Firm*—Frederick P. Weidner; Francis H. Boos

[57] ABSTRACT

A treating agent dispenser system for an automatic washing machine of the top loading type having an outer tub and a basket spaced inwardly therefrom. There is a dispenser having an upper housing portion and a lower housing portion adapted to be mounted above the machine's wash tub and has a plurality of compartments for receiving treating agents to be dispensed into the wash tub at predetermined times in a cycle of the washing machine. One of the compartments is for a bleach agent and has a surrounding upstanding wall and a channel in the bottom thereof with a drain opening therein. A sealing gasket is provided between the upstanding wall and upper housing portion. Ribs outside the compartment converge toward each other and terminate at an opening in communication with the adjacent compartment for directing any bleach leaking from the bleach compartment into the adjacent compartment for subsequent diluting before being dispersed onto the clothes.

6 Claims, 5 Drawing Figures

WASHING MACHINE WITH IMPROVED ADDITIVE DISPENSING MEANS

BACKGROUND OF THE INVENTION

1. Field of the Invention

This invention relates to laundry machines, and more particularly to apparatus used in the dispensing of laundry agents of laundry machines.

2. Description of the Prior Art

Recent automatic clothes washing machines customarily proceed through a sequence of operations or cycles in order to wash, rinse and spin dry clothes. The sequence ordinarily includes a presoak, a first liquid extraction operation, a wash operation, a second liquid extraction operation, a rinse operation, and a final extraction operation.

In order to obtain the most desirable results from these machines, it has been found advantageous to introduce certain additives or agents into the water or liquid used for a particular operation. A prewash agent is normally used in the soak operation, a soap or detergent is normally used in the washing operation and a bleach is often also used in this operation, while rinse agents are added to the rinse water.

In an automatic washing machine, it is desirable that these agents be dispensed automatically. When the dispensing of agents is automatic, the user may load the fabrics to be washed into the wash basket and place the agents into their proper compartments or containers, and the machine automatically completes the cycle of operation. Also, the best results are obtained if some of these various agents are dispensed with liquid so that the additives are metered into the wash basket and evenly distributed rather than being concentrated into a few of the articles.

One such dispensing system for an automatic washing machine is disclosed in U.S. Pat. No. 3,727,434 assigned to the same assignee as the present invention. As disclosed in that patent, the dispenser is normally latched to the access cover or lid of the laundry machine for movement with the lid in an open position for access to the wash basket for loading fabrics.

The dispenser includes a plurality of compartments for storing treating agents to be dispensed selectively during the prewash, wash and rinse operation and a plurality of liquid inlets arranged to communicate with the compartments. In its operative effective position over the basket the liquid inlets are in a position to cooperate with the oulets of a liquid supply device. A liquid supply device is sequentially controlled to selectively direct liquid into preselected ones of the liquid inlet for mixing liquid with the treating agents being held in the compartments to flush the agents into the wash basket at predetermined times in a cycle of the automatic washing machine.

In such a dispenser as described above, the dilution and flushing of bleach is particularly troublesome because of its propensity to discolor clothes if the bleach has not been properly diluted sufficiently prior to introduction into the basket containing the clothes. It is also desirable to have the diluted bleach dispensed not onto the clothes but rather into the liquid being used for the wash operation. In the dispensing of bleach by the dispensing system disclosed in the above-mentioned patent, bleach is diluted by recirculating water, that is, water that is pumped from the wash tub and then reintroduced back into the tub. The bleach diluting tank is evacuated by a siphon tube, however, one of the difficulties with this arrangement is that recirculation water contains lint or other relatively large contaminants which when introduced into the bleach compartment can clog the siphon and render its operation unusable. Prior art has improved that additive dispensing system by providing a means for diluting the bleach and fushing it from its compartment with fresh liquid and dispensing it into the wash water and not onto the fabrics being washed. Even in this system there is, however, the possibility that after the bleach has been placed in its dispensing compartment the lid of the machine is raised thus allowing some of the bleach to spill out of the compartment and find its way onto the clothes in the basket without being diluted.

By my invention I have improved the prior art additive dispensing systems in that I have provided a means of diluting any such spilled bleach before it comes in contact with the clothes.

SUMMARY OF THE INVENTION

There is provided a treating agent dispenser system for an automatic washing machine of the top loading type having a cabinet, an outer tub, and a basket spaced inwardly therefrom that contains the fabric to be washed. The dispenser system includes a dispenser having an upper housing portion separable from a lower housing portion and adapted to be mounted above the machine's wash tub. The dispenser has a plurality of compartments for receiving treating agents to be dispensed into the wash tub including a bleach agent compartment and an adjacent compartment. A liquid supply means is arranged for directing liquid into the adjacent compartment to flush that compartment at a predetermined time in a cycle of the automatic washing machine.

This invention relates to an improvement in such a dispensing system and consists of providing the bleach compartment with a surrounding upstanding wall, a channel in the bottom thereof and a drain opening therein. The bleach compartment has an overlying sealing gasket between at least a portion of the upstanding wall of the compartment and the dispenser upper housing portion. Outside of the bleach compartment are ribs that terminate at an opening in flow communication with the adjacent dispenser compartment. These ribs direct any bleach agent escaping the bleach compartment other than through the drain opening into the adjacent dispenser compartment where subsequently it will be diluted before dispensed onto the clothes.

DESCRIPTION OF THE PREFERRED EMBODIMENT

Figure 1:
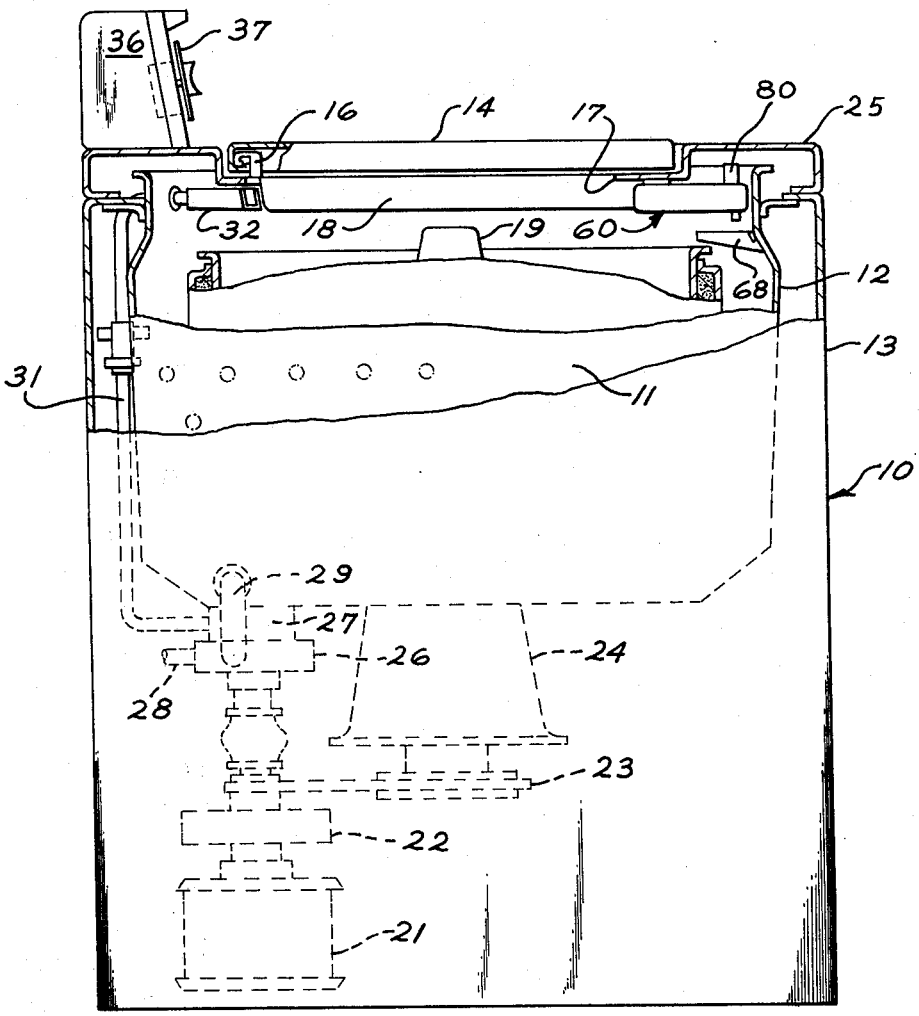
FIG. 1 is a schematic side elevational view of a clothes washing machine incorporating my invention, the view being partly broken away and partly in section.

Referring now to FIG. 1, there is shown a washing machine 10 having a conventional perforated wash basket 11 disposed within an outer imperforate liquid retaining tub 12. With this combination, the basket 11 and tub 12 form suitable means for containing liquid and the fabrics to be washed in said liquid. The outer tub 12 is rigidly mounted within an appearance cabinet 13 which includes an access cover or lid 14 mounted by hinges 16 on the top portion of the cabinet for providing access through an opening 17 to the basket 11. The hinges 16 are at the rear of the machine so the lid 14 is opened front to back.

Shown positioned over the basket 11 and projecting into the opening 17 is a wash water treating agent dispenser 18 which includes the present improvement invention for the dispensing system. Preferably this is effected by removably mounting the dispenser 18 to the underside of the access lid 14 by suitable means. At the center of the wash basket 11 there is positioned an agitator 19 for flexing clothes during the washing operation. Conventionally, the basket 11 is mounted for rotation and the agitator 19 is mounted for some type of oscillatory motion which will effect washing action on the clothes in the basket 11.

Basket 11 and agitator 19 are driven from a reversible motor 21 through a drive including a clutch 22 which through a suitable belt 23 transmits power to a transmission 24. When the motor 21 is rotated in one direction the transmission causes a slow speed oscillation of the agitator 19. Conversely, when the motor is driven in the opposite direction the transmission drives both the basket 11 and agitator 19 at a high speed for centrifugal extraction of the liquid from the fabrics within the basket.

In addition to operating the transmission 24 as described, motor 21 also provides a direct drive to a pump structure that includes separate pumping units 26 and 27. During the high speed operation pump 26 draws liquid from the outer tub 12 through conduit 29 and discharges it through conduit 28. During wash or slow speed the pump 27 draws liquid from the tub and discharges through conduit 31. Conduit 31 extends up and terminates in the tub wall and directs liquid flow into the dispenser 18 and basket 11.

Mounted on the cabinet 13 is a control compartment 36 in which are located control devices, including a cycle controller 37 which conducts the washing machine through cycles of operation.

The dispensing system provided for the automatic fabric washing machine 10 allows the user of the machine to select and store one or a combination of laundry additives or agents to be dispensed at preselected intervals in the cycle of an automatic washing machine. A diverter 32 is fixedly mounted within the cabinet and is arranged to cooperate with the dispenser 18 for introduction of liquid into the dispenser that will be discussed later in the description of the operation of the present invention. The diverter is controlled in response to signals from the cycle controller 37. Liquid is introduced into the diverter by recirculating liquid from the wash tub by the pump 26 through conduit 31.

Figure 2:
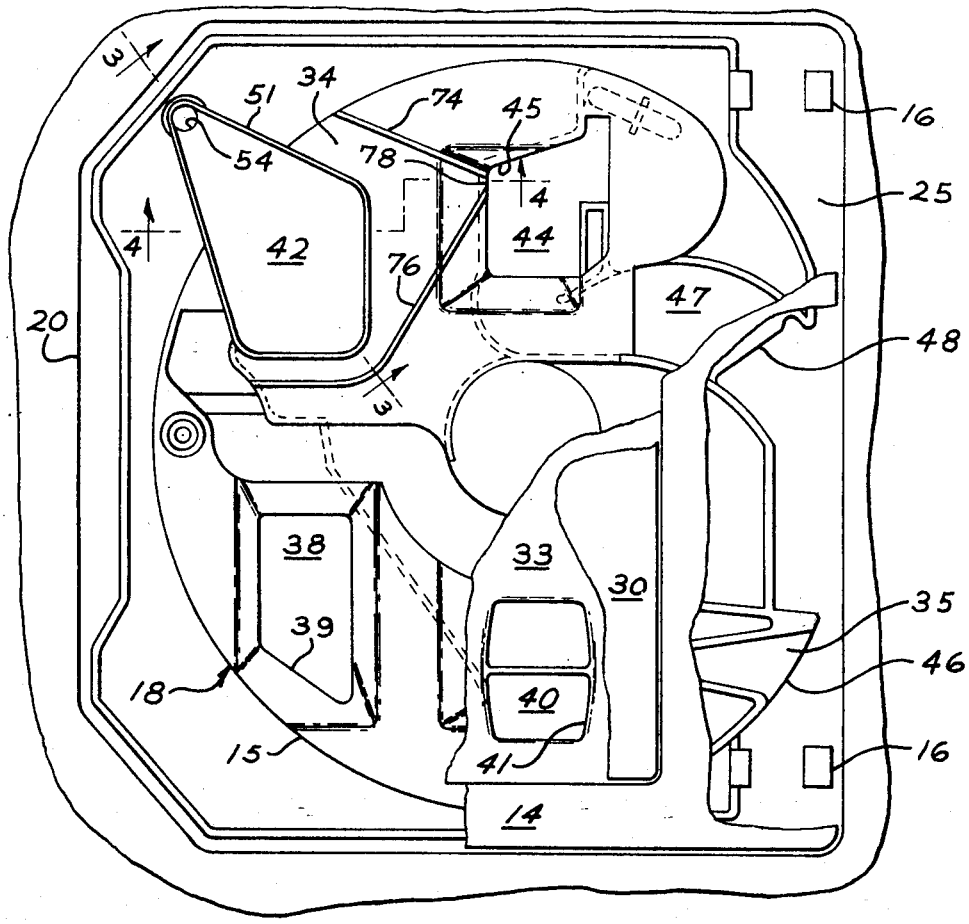
FIG. 2 is a plan view of the dispensing system showing the present improvement invention with parts broken away.
Figure 3:
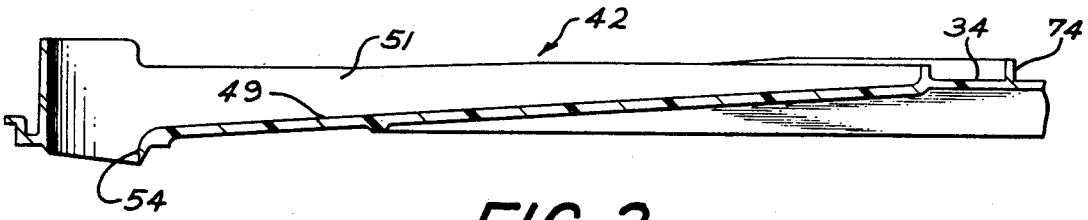
FIG. 3 is a fragmentary sectional view taken along lines 3—3 of FIG. 2.
Figure 4:
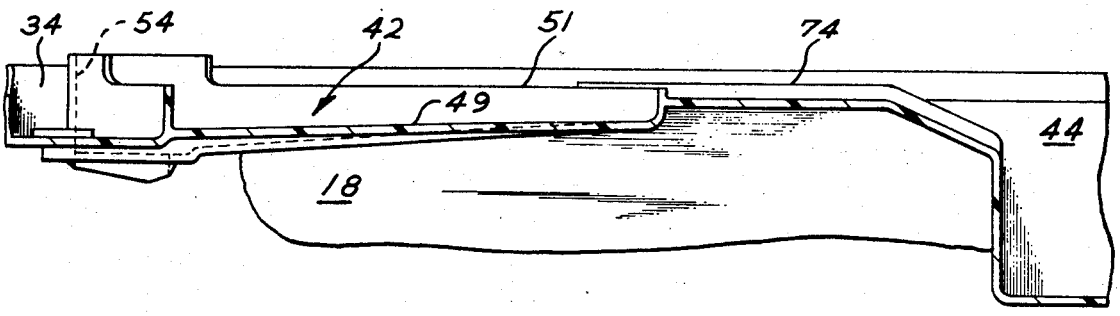
FIG. 4 is a fragmentary sectional view taken along lines 4—4 of FIG. 2.

Referring to FIG. 2, the dispenser 18 for an automatic clothes washer is shown with the cover partially broken away to expose the details of construction of the present embodiment. The dispenser 18, as shown, is generally an annularly-shaped segmented channel or trough having an outer wall 15. The dispenser 18 is divided into four annular compartments 38, 40, 42, and 44. The presoak agent is placed in compartment 40 through opening 41 in upper housing portion 33, detergent is placed in compartment 38 through opening 39, bleach is placed into compartment 42 through opening 43 (FIG. 5), and rinse agent is placed in compartment 44 through opening 45.

Compartment 40 is not designed to store a treating agent but merely provides a passageway for introducing prewash liquid treating agents directly into the washing machine to be effective during the first fill cycle of the machine. To this end the bottom wall portion of the compartment 40 has a large opening to facilitate easy dispensing of the prewash agent.

Liquid being introduced into the dispenser 18 by the liquid flow diverter mechanism 32 is automatically selectively diverted and flows to compartment 38 through channel 35 from inlet 46. Liquid for compartment 44 flows through channel 47 from inlet 48 to the compartment. No liquid is needed for compartment 42 as will be explained later.

The liquid flow diverter mechanism is sequentially controlled to selectively direct liquid into preselected inlets 46 and 48 for mixing liquid with the treating agents being held in the compartments to flush the agents into the wash tub at predetermined times in a cycle of the automatic washing machine.

Figure 5:
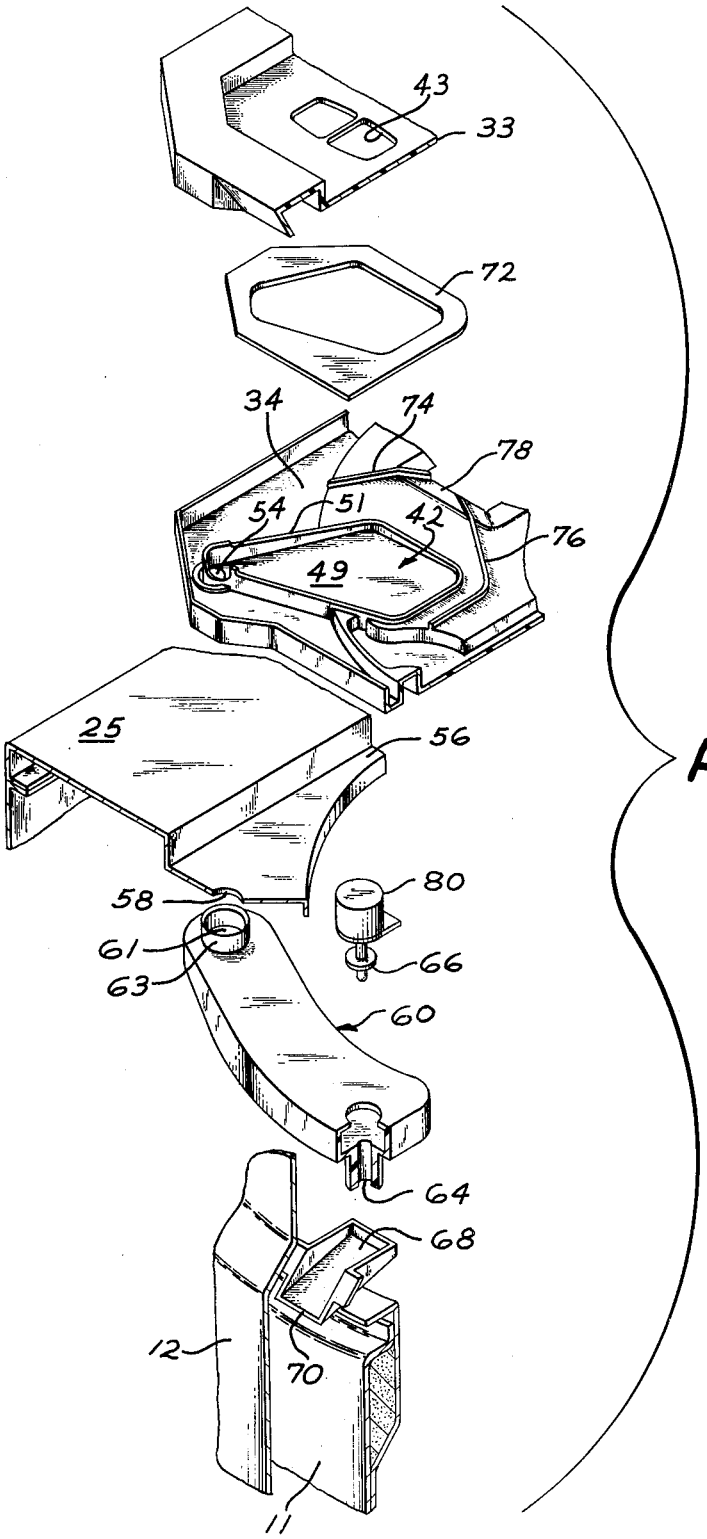
FIG. 5 is a perspective view of the dispensing system of the present invention with parts broken away.

While the dispensing system utilizes a plurality of laundry agents introduced into the wash from different compartments, this invention relates to introducing bleach and provides for an assurance that raw or undiluted bleach is not dispensed onto the fabrics to be washed which are retained within the basket 11. The dispensing system includes a top panel opening 43 in the upper housing portion 33 of the dispenser 18 into which the bleach is poured. The top panel openings including opening 43 have a cover 30 (FIG. 2) that is hinged to the larger access lid 14. With particular reference to FIG. 5, the bleach poured into opening 43 flows into the underlying compartment 42 formed in the lower housing portion 34 of the dispenser 18. Compartment 42 has a bottom wall or channel 49 that is sloped toward a drain opening 54 at one end of the channel. Underlying the drain opening 54 is a cabinet portion 56 into which is recessed the access cover or lid 14 of the washing machine 10. This cabinet portion 56 has an opening 58 vertically disposed underneath the drain opening 54 so that the bleach passing through drain opening 54 will also pass down through opening 58 in the cabinet top wall. This opening 58 forms one means of liquid flow communication between the drain opening 54 and a holding tank 60, one end of which tank has an opening 61 with a surrounding collar 63 which is also vertically disposed underneath the drain opening 54. Drain opening 54, cabinet opening 58 and holding tank opening 61 are in vertical axial alignment with each other. The holding tank 60 is a curved structure and is stationarily affixed to the washing machine 10.

At the end of the holding tank 60 opposite the opening 61 is another opening 64 in the bottom thereof which may be opened and closed by a stopper 66 arranged to be actuated by the controls of the machine, such as by a solenoid 80.

Underneath opening 64 of the holding tank is a trough 68 that has its terminal lip 70 in the space between basket 11 and tub 12.

The operation of the treating agent dispenser system is as follows. The washing machine operator pours bleach through top panel opening 43 where it passes into bleach compartment 42 and flows down channel 49 to drain opening 54. By gravity the bleach passes through drain opening 54 and correspondingly through opening 58 in the cabinet top wall and opening 61 in the top wall of the holding tank where it then enters the holding tank 60 and is retained therein as the stopper 66 is in a position closing opening 64.

The washing machine is then started by the user by actuating the necessary controls including the cycle controller 37. At a preselected time in the cycle the stopper 66 is opened by the machine controls and the bleach passes through opening 64, down through 68 and falls into the space between the tub 12 and inner basket 11. In this manner it will be appreciated that the bleach is not dispensed onto the clothes within the basket 11 but rather is directed down into the underlying wash liquid.

The cycle controller 37 may proceed with the automatic dispensing of a rinse laundry agent from the other compartment of the dispenser system as appropriate in the washing cycle such that incoming rinse liquid will pass into the dispenser 18 via inlet 48 and then to the rinse agent compartment through channel 47 thereby flushing it into the underlying tub. After the rinse operation the wash tub is drained preparatory for the next wash load.

My invention relates to an improvement for the dispensing system described above and relates to a structural arrangement for preventing any undiluted bleach from being deposited onto the clothes that are in the basket for washing. It can happen that after the machine operator pours raw or undiluted bleach into bleach compartment 42, it may not all drain from the compartment through opening 54 and when the cover or lid 14 is raised it is possible for the raw bleach to spill out of compartment 42. To help prevent any bleach spillage I provide a resilient sealing gasket 72 on top of at least a portion of the surrounding upstanding wall 51 and in sealing engagement with the upper housing portion 33. However, the upper housing portion 33 and lower housing portion 34 are provided with a means of detaching or separating one from the other so that access to the interior of the dispenser for cleaning and maintenance is provided. There is the possibility that with repeated separation of the two housing portions that gasket 72 will lose its sealing efficiency. In that event, it is possible that undiluted bleach will escape from the bleach compartment 42 other than through the drain opening 54. To further prevent any bleach that may possibly leak through sealing gasket 72 from being deposited onto the clothes, I provide for upstanding ribs 74 and 76 outside of the bleach compartment 42 which converge toward each other and terminate at an opening 78 that is in flow communication with an adjacent compartment 44. In the embodiment shown, the opening 78 is a breakthrough ribs 74 and 76, however, some other opening arrangement in flow communication with the adjacent compartment could be provided. The adjacent compartment is for the rinse water additive which is flushed in the operational cycle of the washing machine at the end of the cycle by liquid being directed into the compartment via inlet 48 and channel 47. In this manner then it is assured that any bleach leaking from compartment 42 is directed by ribs 74 and 76 to flow through opening 78 into compartment 44 and that it will be diluted during the flushing of the rinse agent compartment 44 before being dispensed onto the clothes.

The adjacent compartment is located between the bleach compartment 42 and the side of the lid 14 hingedly attached to the cabinet top 25 by hinges 16. In this manner when the lid 14 is raised by gripping the front 20 and lifting, any raw bleach escaping compartment 42 will be directed by gravity to the upstanding ribs 74 and 76 and guided thereby on into the adjacent compartment. In this embodiment shown the lid 14 opens front to back with respect to the machine. The lid 14 could be hinged at the side if so desired. In that event it would be preferred to arrange the compartments so that the adjacent compartment would again be between the bleach compartment and the hinged side of the lid 14.

The foregoing is a description of the preferred embodiment of the invention and variations may be made thereto without departing from the true spirit of the invention, as defined in the appended claims.

What is claimed is:

1. In a treating agent dispenser system for an automatic washing machine of the top loading type having a cabinet with an access lid on the top wall thereof, an outer tub, and a basket placed inwardly therefrom, including a dispenser adapted to be mounted above the machine's wash tub, said dispenser having an upper housing portion, a lower housing portion, a bleach agent compartment, an adjacent compartment in communication with a liquid supply means arranged for directing liquid into said adjacent compartment to flush said compartment at a predetermined time in a cycle of said automatic washing machine, the improvement comprising:

a. the bleach compartment having a surrounding upstanding wall, a channel in the bottom thereof with a drain opening therein, b. a sealing gasket overlying the bleach compartment and located between at least a portion of the upstanding wall and the dispenser upper housing portion, and c. a rib outside the compartment, said rib terminating at an opening in flow communication with the adjacent dispenser compartment for directing any bleach escaping the bleach compartment other than through the drain opening into the adjacent dispenser compartment.

2. The treating agent dispenser system of claim 1 wherein the dispenser is mounted on the access lid and the lid is hingedly secured at one side thereof to the cabinet top wall.

3. The treating agent dispenser system of claim 2 wherein the adjacent compartment is between the bleach compartment and the hinged side of the lid.

4. The treating agent dispenser system of claim 3 wherein the hinged side of the lid is at the rear of the machine so the access lid opens front to back.

5. The treating agent dispenser system of claim 1 wherein the predetermined time in a cycle of the automatic washing machine for flushing the adjacent compartment is when the machine is being filled with liquid for the rinse operation.

6. The treating agent dispenser system of claim 1 wherein two ribs converge toward each other and the opening in flow communication with the adjacent dispenser compartment is through the ribs.

* * * * *